US005163726A

United States Patent [19]

Boos et al.

[11] Patent Number: 5,163,726

[45] Date of Patent: Nov. 17, 1992

[54] SPREADER BAR AND OVERHEIGHT ATTACHMENT WITH AUTOMATIC LATCHING MECHANISM

[75] Inventors: Jeffrey J. Boos; Lee A. Hagelbarger, both of Durham; Doyle R. Dawson, Greensboro, all of N.C.

[73] Assignee: Bromma, Inc., Roxboro, N.C.

[21] Appl. No.: 776,176

[22] Filed: Oct. 15, 1991

[51] Int. Cl.[5] ..... B66C 1/10

[52] U.S. Cl. ..... 294/81.1; 294/81.5; 294/67.1

[58] Field of Search ..... 294/81.1, 81.5, 81.51, 294/81.52, 81.53, 81.55, 67.1, 67.3, 67.32, 67.4, 68.3; 410/77, 78, 82, 83

[56] References Cited

U.S. PATENT DOCUMENTS

| | | | |
|---|---|---|---|
| 1,940,242 | 12/1933 | Burgess | 294/68.3 X |
| 3,015,407 | 1/1962 | Fesmire et al. | 294/68.3 X |
| 3,151,904 | 10/1964 | Tantlinger et al. | 294/67 |
| 3,243,224 | 3/1966 | Gutridge | 294/67 |
| 3,249,064 | 5/1966 | Barry | 104/93 |
| 3,257,142 | 6/1966 | Barry | 294/81 |
| 3,493,258 | 2/1970 | Wyrough | 294/67 |
| 3,589,540 | 6/1971 | Kinross | 214/75 |
| 3,690,602 | 9/1972 | Marsh | 244/137 |
| 3,695,667 | 10/1972 | Dempsey | 294/67 |
| 3,829,145 | 8/1974 | Gottlieb et al. | 294/81.1 X |
| 3,874,719 | 4/1975 | Goyarts | 294/81 |
| 3,888,536 | 6/1975 | Durenec | 294/81 |
| 3,980,185 | 9/1976 | Cain | 294/81.53 X |
| 4,221,515 | 9/1980 | Brown et al. | 410/32 |
| 4,244,615 | 1/1981 | Brown | 294/67 |
| 4,341,495 | 7/1982 | Del'Acqua | 294/81.53 X |
| 4,372,597 | 2/1983 | Stillman et al. | 294/67 |
| 4,715,762 | 12/1987 | Lanigan, Sr. et al. | 414/126 |
| 4,899,205 | 8/1975 | Lanigan et al. | 294/81 |

*Primary Examiner*—Margaret A. Focarino
*Assistant Examiner*—Dean J. Kramer
*Attorney, Agent, or Firm*—Richard E. Jenkins

[57] ABSTRACT

A cargo loading system which includes a spreader bar and overheight attachment wherein the overheight attachment incorporates an automatic latching mechanism for the purpose of locking and unlocking engagement of the spreader bar. The automatic latching mechanism is actuated by the twistlocks of the spreader bar and serves to obviate the need for dock-side personnel and the attendant harzardous working conditions posed to these personnel by conventional mounting pin attachment of the spreader bar and overheight attachment.

16 Claims, 9 Drawing Sheets

SPREADER BAR AND OVERHEIGHT ATTACHMENT WITH AUTOMATIC LATCHING MECHANISM

DESCRIPTION

1. Technical Field

The present invention relates generally to equipment for lifting cargo containers and more particularly to a novel automatic latching mechanism for securing an overheight attachment to a spreader bar for greater ease of handling certain shipping containers such as flat racks and pallets.

2. Related Art

In the past, the cargo industry has utilized equipment well known to the industry as "spreader bars" in order to transfer cargo from ship to shore or between ground locations. The spreader bars are typically attached by suitable cables to gantry cranes, boom cranes, straddle cranes or the like in order to move the cargo which has been engaged by the spreader bar from one desired site to another.

Historically, a device known as an overheight attachment has been utilized with spreader bars when it was desired to engage a cargo load on a flat rack or pallet as opposed to the conventional rectangular box-like cargo containers engaged by unassisted spreader bars. The overheight attachment is attached to the spreader bar with a removable pin connection at each corner thereof so as to provide four downwardly extending legs to facilitate engagement of the aforementioned flat rack and pallet cargo loads. Unfortunately, as is well known to those familiar with cargo handling at dock sites and the like, it typically requires at least fifteen minutes or so to align a spreader bar and overheight attachment and to secure the units together with mounting pins at the four contacting corners thereof. This conventional technique for securing an overheight attachment to a spreader bar requires several dock-side personnel and exposes them to potentially hazardous working conditions during the manual connection of the overheight attachment to the spreader bar.

Accordingly, there has been a long-felt need for an automated mechanism which would enable the spreader bar to automatically engage the overheight attachment in a fast and reliable manner so as to obviate the necessity for dock-side personnel to accomplish the task and the attendant risk to which these personnel are exposed during the manual connection procedure.

Applicant is not aware of any prior art patents which disclose a mechanism for automatically securing a spreader bar and an overheight attachment. Of some interest, U.S. Pat. Nos. 3,249,064 and 3,257,142 to Barry disclose a material handling system wherein an overhead carrier which is adapted to travel along a monorail is provided with automatic latching hooks at each of the four corners thereof for engaging a rack having four upwardly extending legs. Also, of general interest is U.S. Pat. No. 3,899,205 to Lanigan et al. which discloses automated latch arms on lifting spreaders for engaging a cargo container.

DISCLOSURE OF THE INVENTION

In accordance with the present invention, applicant provides a cargo loading system comprising a spreader bar assembly having a rectangular frame with a downwardly depending first twistlock at each corner thereof. A detachably engageable overheight attachment is provided which comprises a frame having a leg depending downwardly from each corner thereof with a second twistlock at the bottom of each leg and the top of each leg adapted for engagement by the spreader bar assembly. A twistlock actuation means is provided within each corner leg whereby each of the second twistlocks can be actuated by a corresponding one of the first twistlocks in the spreader bar assembly. Latching means are operatively connected to the legs of the overheight attachment and adapted to the actuated by the first twistlocks of the spreader bar assembly for coupling of the spreader assembly and overheight attachment. An overheight attachment storage frame is provided which comprises a rectangular base defining first and second storage positions and an arm extending upwardly from each corner which has biasing means at the upper end thereof to maintain the latching means of the overheight attachment in an inoperative position when the overheight attachment is stored in the first storage position and in an operative position when the overheight attachment is stored in the second storage position.

It is therefore the object of the present invention to provide an improved mechanism for latching an overheight attachment to a spreader bar.

It is another object of the present invention to provide an automatic latching mechanism for securing an overheight attachment to a spreader bar.

It is another object of the present invention to provide an automatic latching mechanism for securing an overheight attachment to a spreader bar which can be accomplished in significantly less time than with conventional manual attachment with mounting pins.

It is yet another object of the present invention to provide an automatic latching mechanism for securing an overheight attachment to a spreader bar which eliminates the necessity for additional dock-side personnel required in conventional manual attachment with mounting pins.

It is still another object of the present invention to provide an automatic latching mechanism for securing an overheight attachment to a spreader bar which eliminates the exposure of dock-side workers to potential injuries which could be incurred in the hazardous manual attachment procedure.

Some of the objects of the invention having been stated, other objects will become evident as the description proceeds when taken in connection with the accompanying drawings.

BEST MODE FOR CARRYING OUT THE INVENTION

Figure 1:
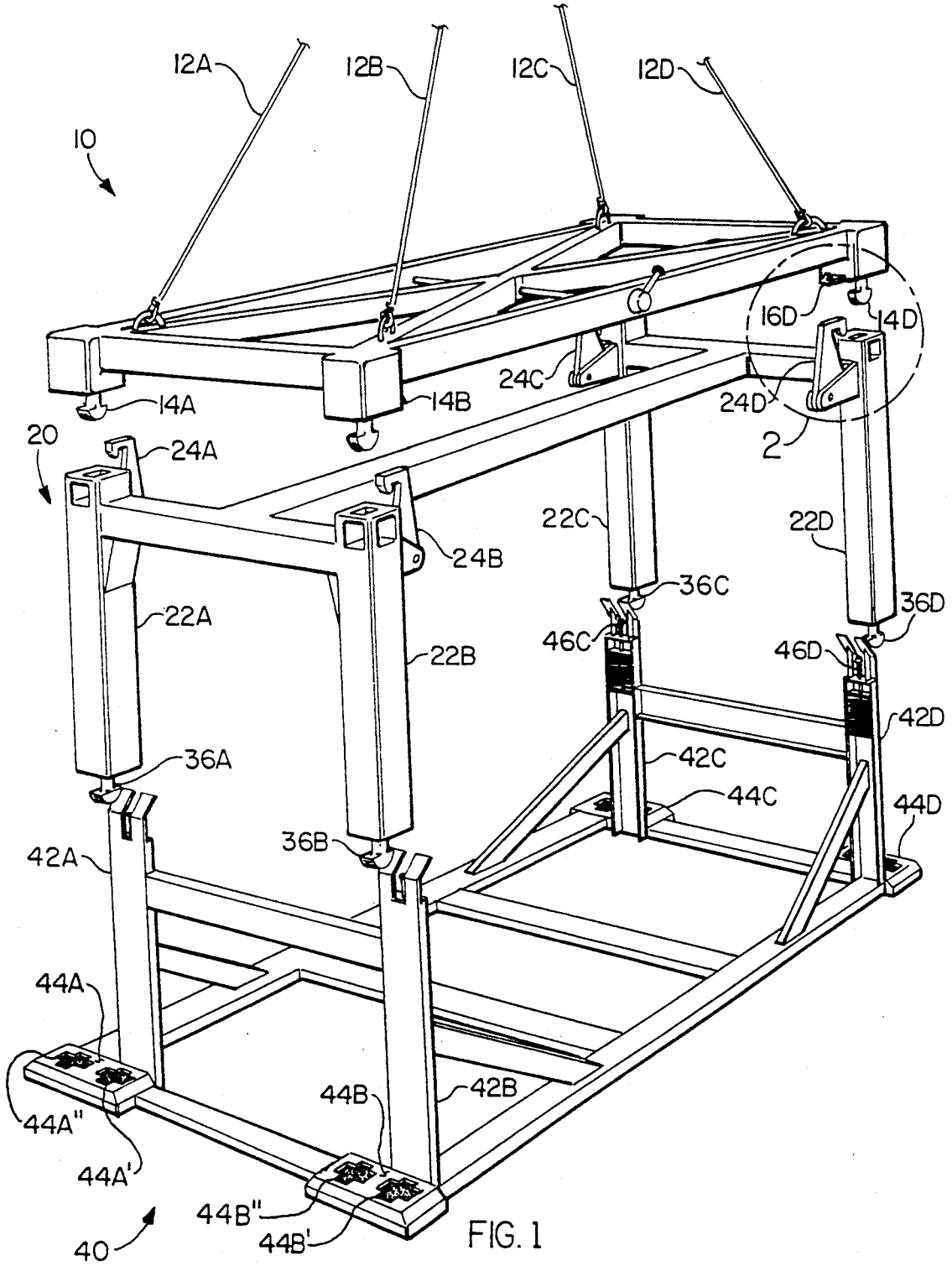
FIG. 1 is a perspective exploded view of a cargo loading system in accordance with an exemplary embodiment of the present invention.

Referring now to the drawings, FIG. 1 shows a spreader bar 10 which is suspended from a suitable crane or the like (not shown) by support cables 12A–12D. Spreader bar 10 includes conventional twistlocks 14A–14D at each corner thereof which are conventionally utilized in order for spreader bar 10 to engage a rectangular box-like shipping container to transfer cargo at a dock facility or the like. An overheight attachment 20 is shown which is detachably engageable by spreader bar 10 in order to facilitate lifting of cargo loads which have been positioned on flat racks, pallets or the like. A storage frame 40 is also shown which serves as a part of the automatic latching mechanism of the present invention and which will be described in detail hereinbelow.

Figure 2:
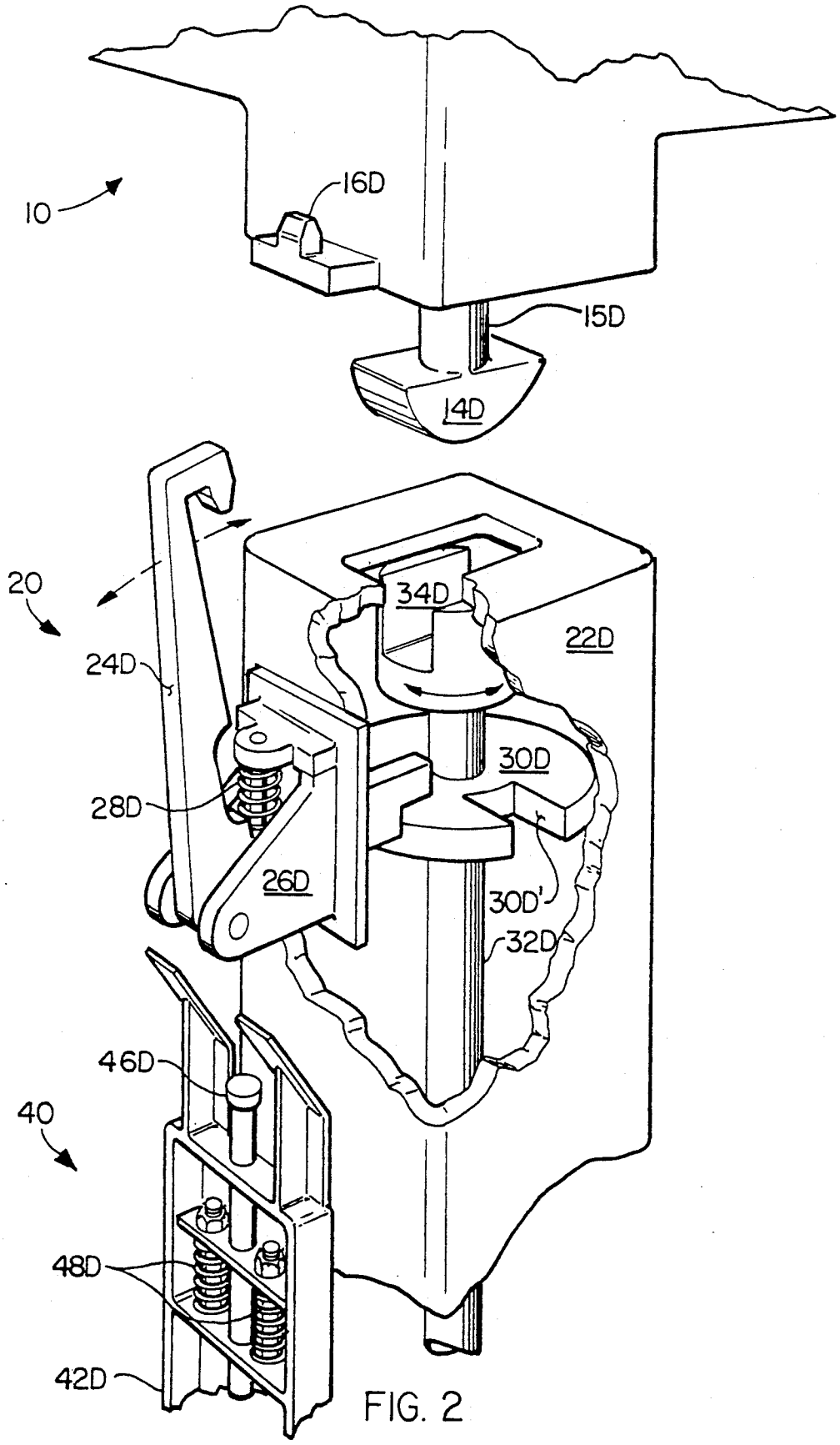
FIG. 2 is a fragmentary view of the structure within the circle 2 of FIG. 1 with the associated storage frame plunger shown in proximity thereto for clarity of understanding.
Figure 3:
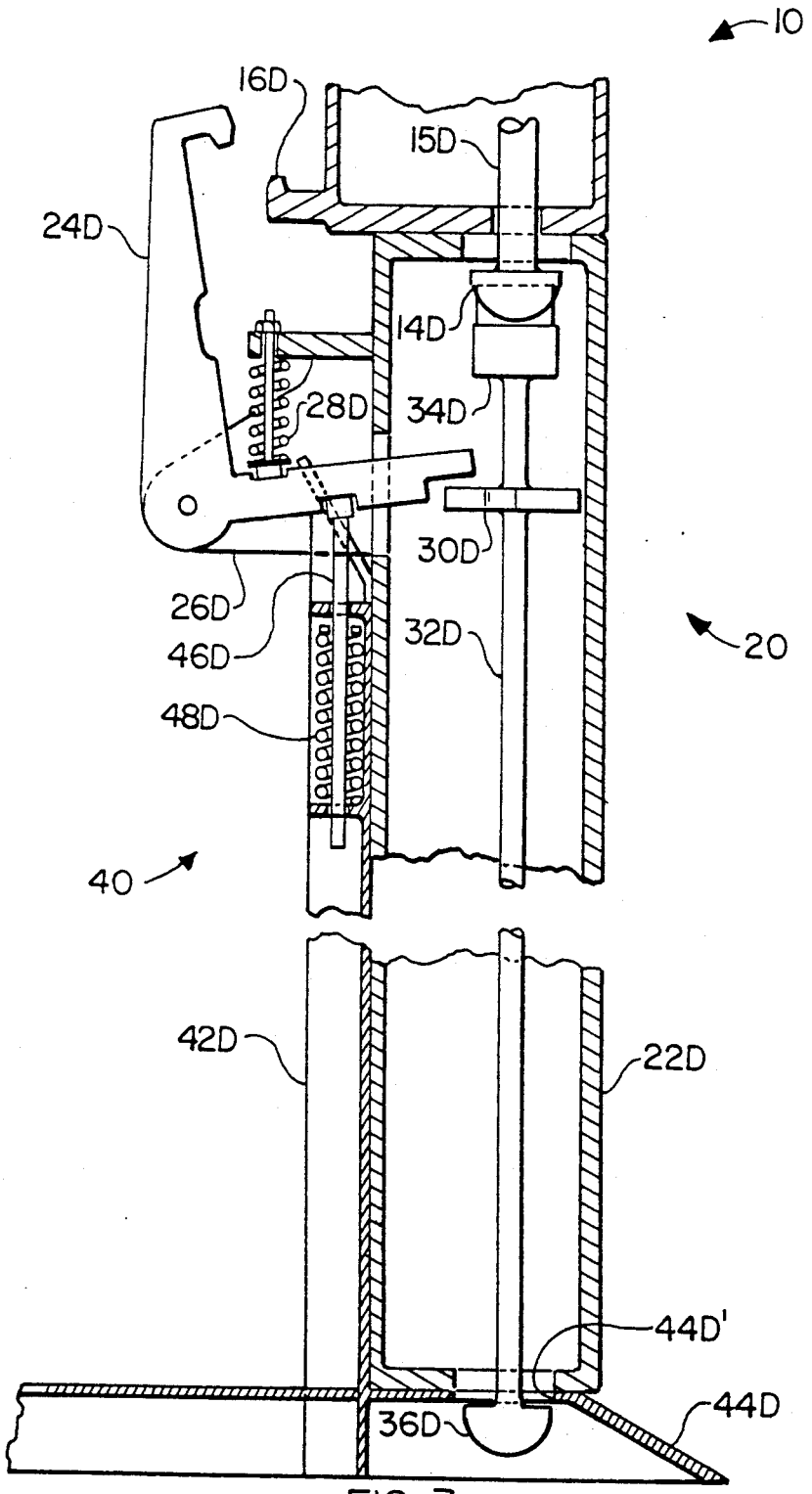
FIG. 3 is a vertical cross-sectional view of the latching mechanism of the cargo handling system wherein the spreader bar has been lowered into engagement with an overheight attachment which is located in the first position of the storage frame.
Figure 4:
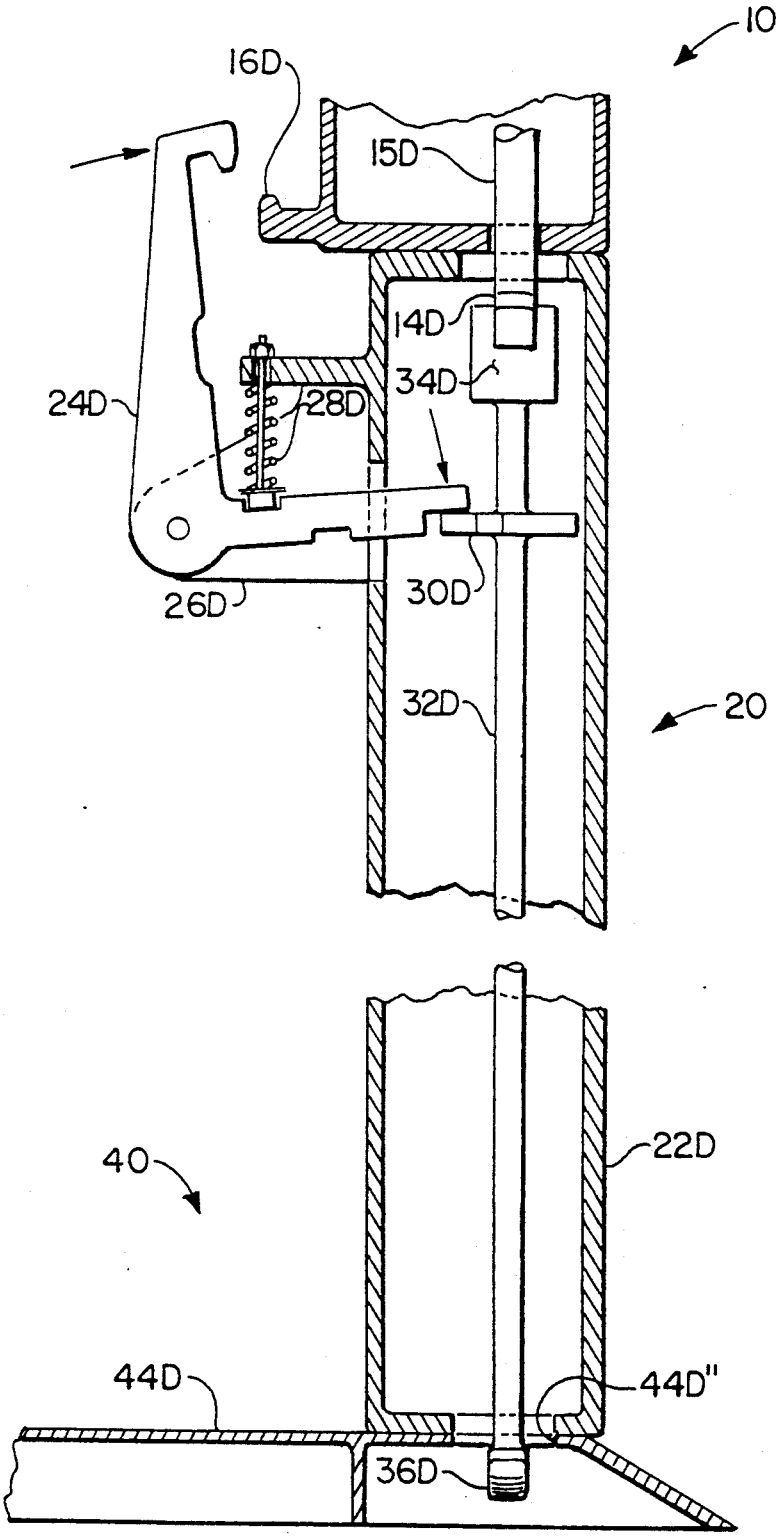
FIG. 4 is a vertical cross-sectional view similar to FIG. 3 but wherein the twistlocks of the spreader bar have been locked and the overheight attachment has been hoisted upwardly and then lowered onto the second position on the storage frame.
Figure 5:
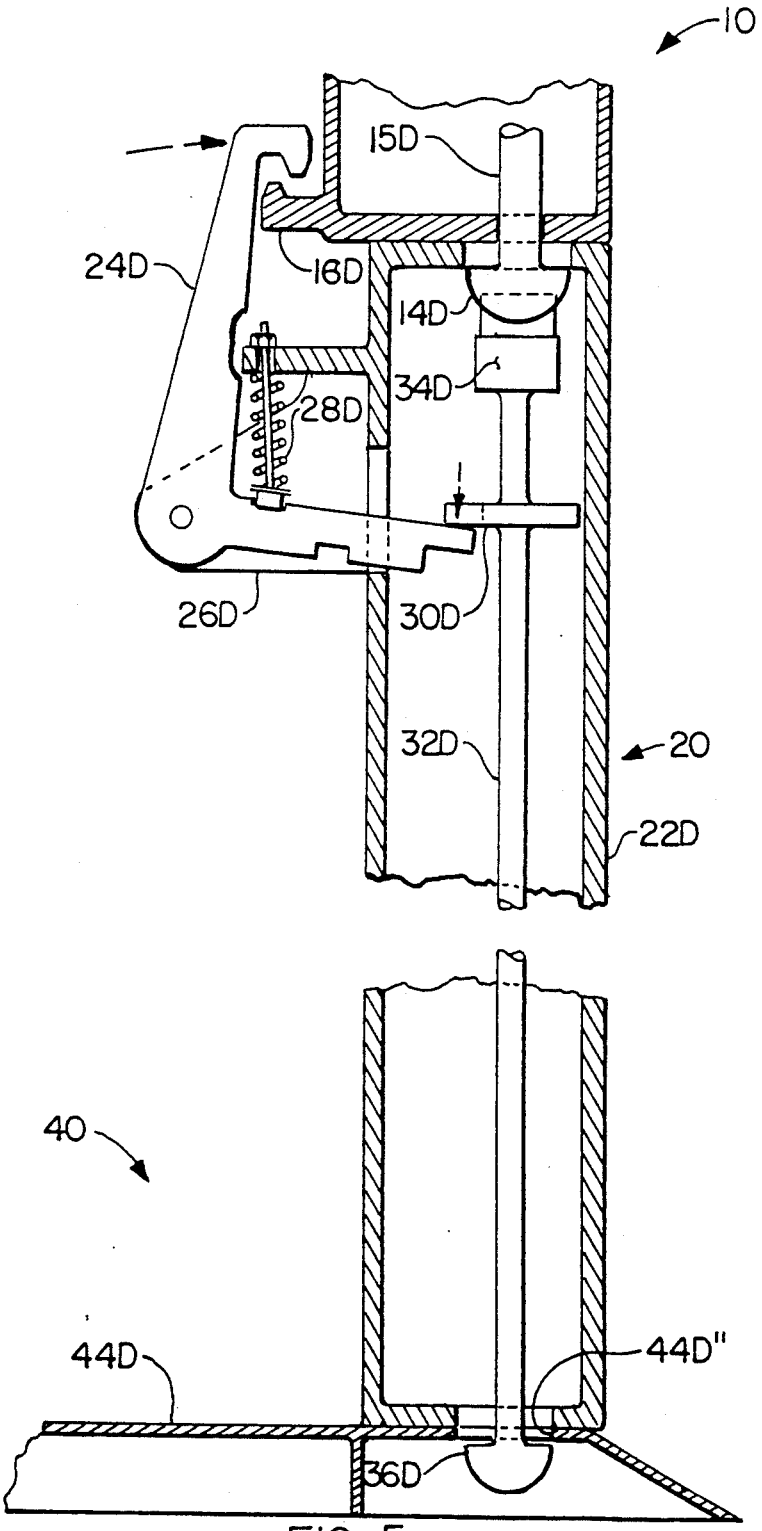
FIG. 5 is a vertical cross-sectional view similar to FIG. 4 but wherein the spreader bar twistlocks have been unlocked so as to allow the latching arm to be urged forwardly to engage the spreader.
Figure 6:
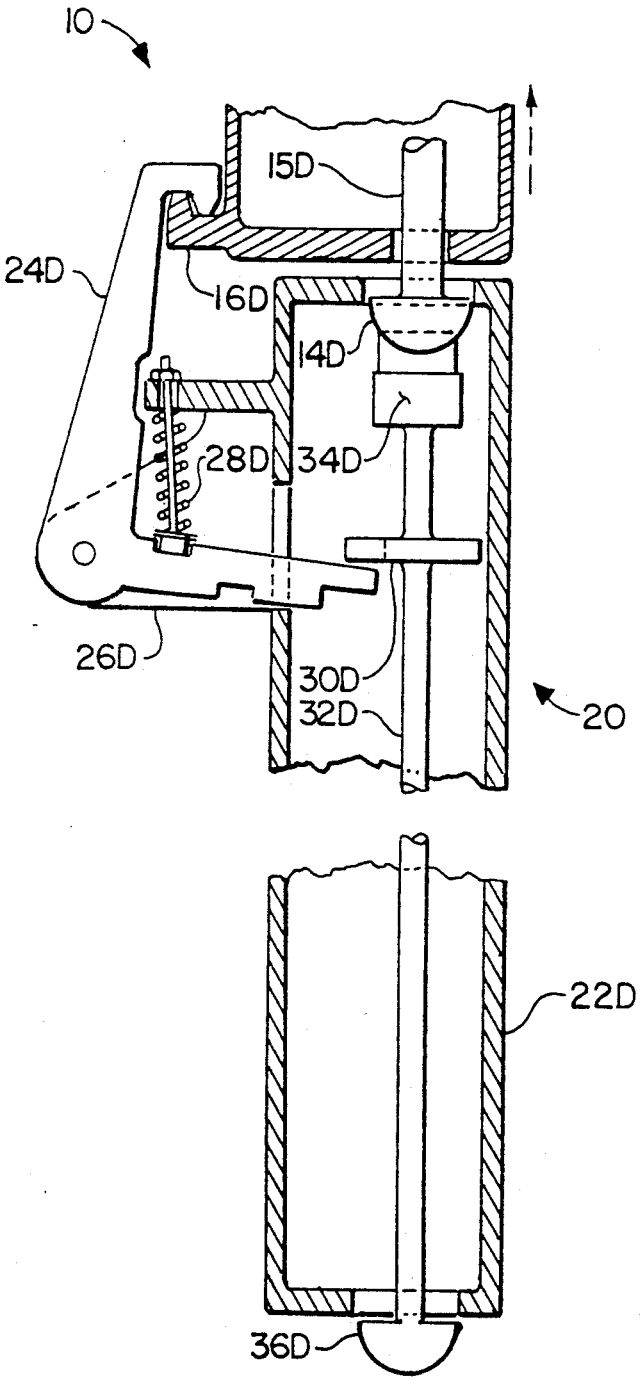
FIG. 6 is a vertical cross-sectional view similar to FIG. 5 but wherein the spreader bar and overheight attachment have been hoisted from the storage frame and are ready to engage a cargo load.
Figure 7:
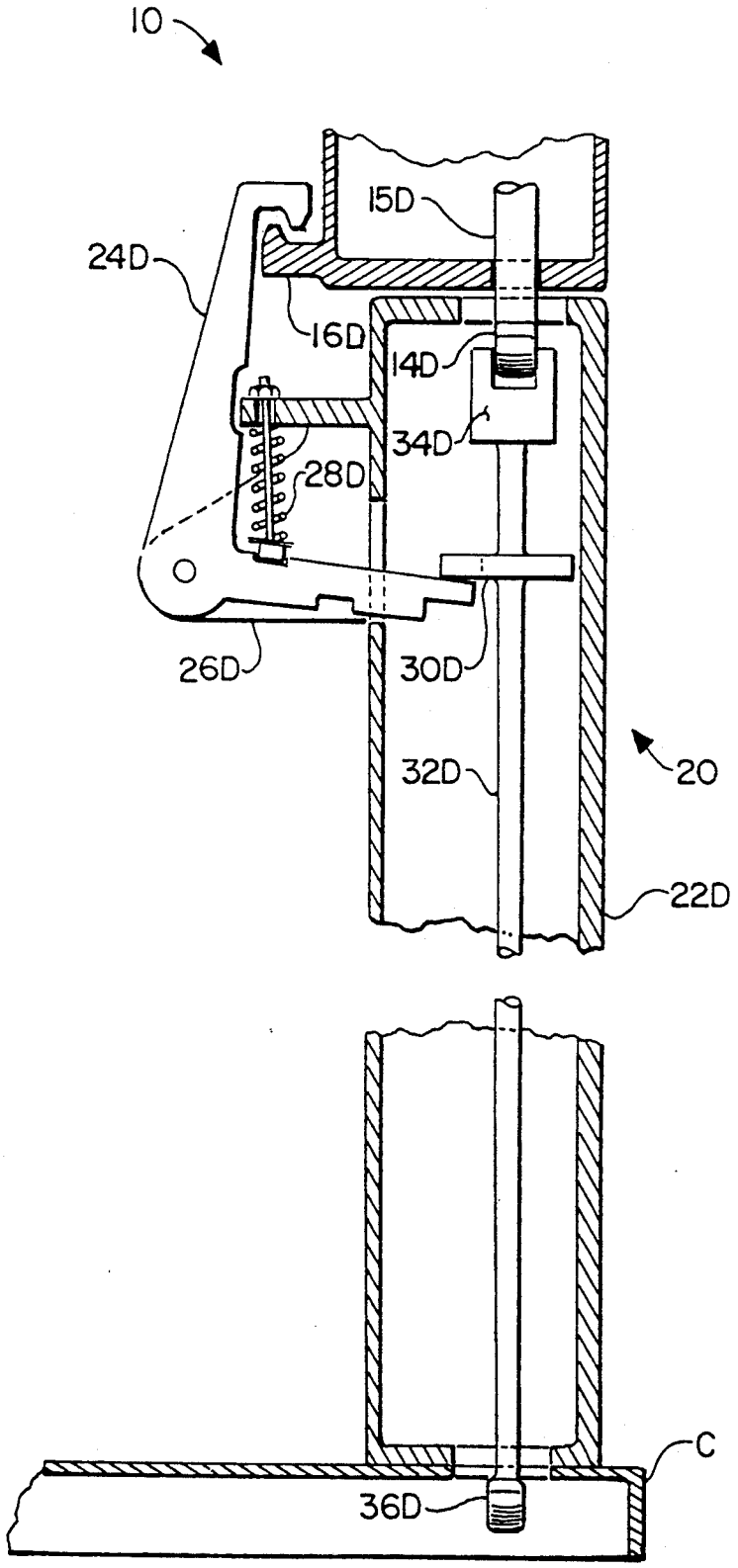
FIG. 7 is a vertical cross-sectional view similar to FIG. 6 but wherein a cargo load container has been engaged and the spreader bar twistlocks rotated to a locked position so as to rotate the operatively connected overheight attachment twistlocks to a locked position for lifting of a cargo load container.
Figure 8:
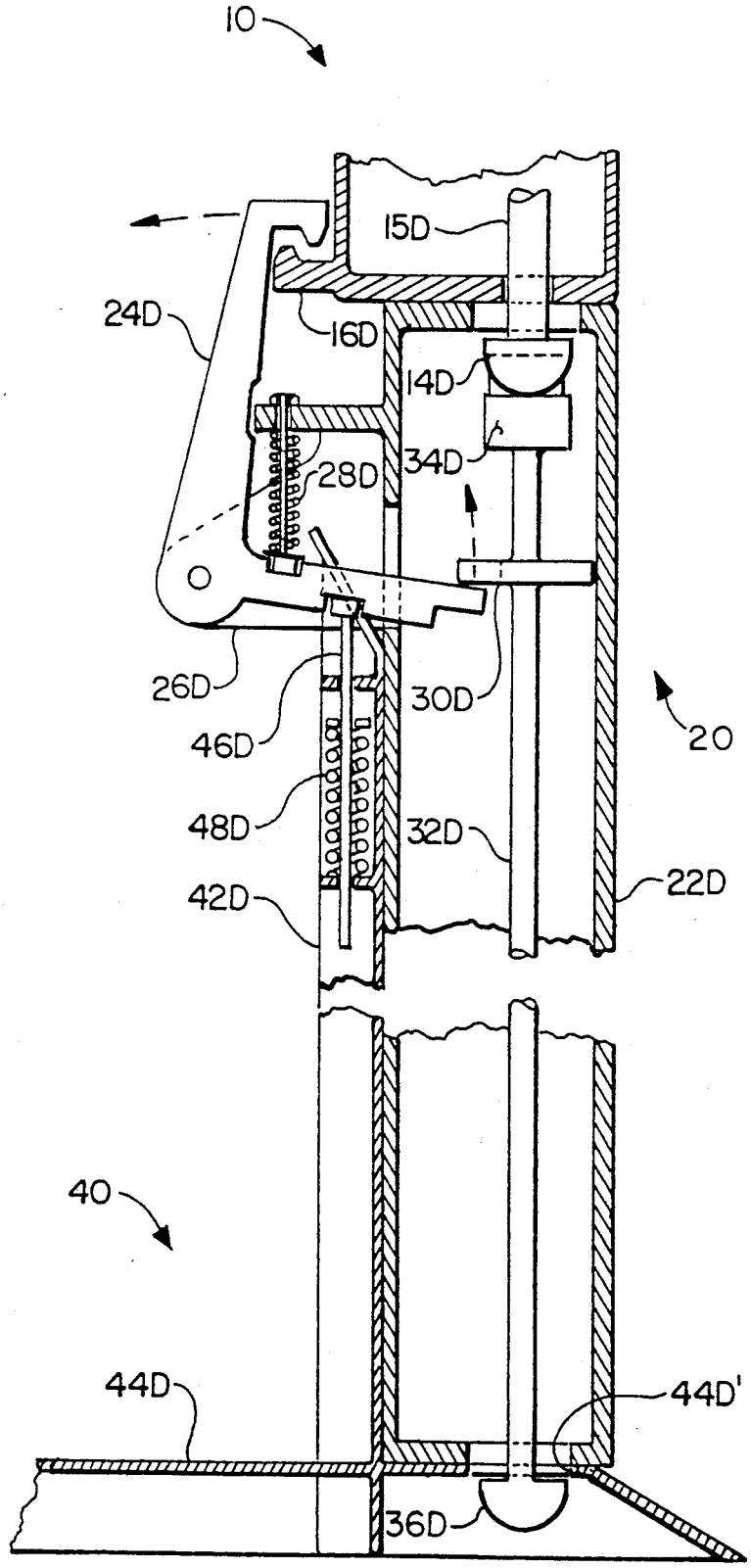
FIG. 8 is a vertical cross-sectional view similar to FIG. 7 but wherein the cargo load container movement has been completed and the overheight attachment has been returned to the first position on the storage frame.
Figure 9:
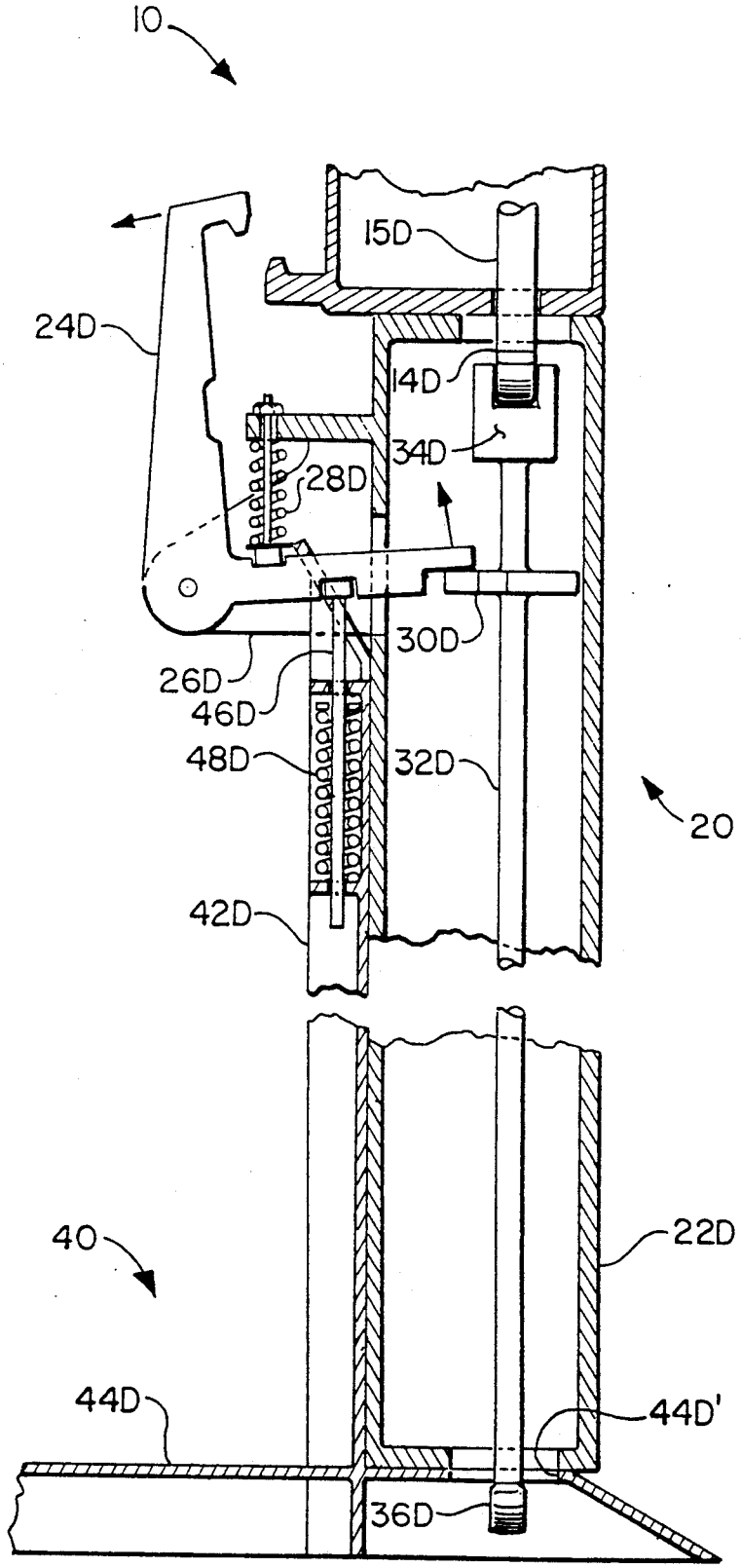
FIG. 9 is a vertical cross-sectional view similar to FIG. 8 but wherein the twistlock has been rotated to a locked position and the latch arm biased into an unlatched position by the storage frame plunger so the twistlock can be rotated back to an unlocked position (not shown) and the spreader bar then removed from the overheight attachment.

Referring now specifically to FIGS. 2–9, applicants will describe the automatic locking mechanism of the present invention. With particular reference now to FIG. 2, it can be seen that spreader bar 10 includes twistlocks 14A–14D at the corners thereof which are rotated by associated integral actuator shafts 15A–15D. Spreader bar 10 further includes associated locking lugs 16A–16D at the corners thereof for engagement by the latching mechanism of overheight attachment 20 which will be described in detail hereinbelow.

Generally, spreader bar 10 is of conventional construction with the exception of the provision of locking lugs 16A–16D at each corner thereof for use in the automatic latching mechanism of the invention. Overheight attachment 20 is also of conventional construction including downwardly depending legs 22A–22D which allow spreader bar 10 to extend over a load supported by a flat rack or pallet and to engage the flat rack or pallet for transferring the cargo from one location to another.

As noted hereinbefore, conventional spreader bar 10 and overheight attachment 20 are conventionally attached by means of mounting pins which are manually inserted through the top portions of each of legs 22A–22D of overheight attachment 20 to engage corresponding corners of spreader bar 10. This labor-intensive and hazardous task has been obviated by applicants' automatic latching mechanism. In lieu of the conventional and well known mounting pin connection of spreader bar 10 and overheight attachment 20, applicants' automatic latching mechanism provides pivotably mounted latch arms 24A–24D adjacent the top of each of legs 22A–22D of overheight attachment 20. Latch arms 24A–24D are each pivotably mounted in a respective clevis 26A–26D and normally urged inwardly into the spreader bar engagement position by corresponding latch arm springs 28A–28D. Also provided adjacent the top portion of overheight attachment legs 22A–22D are locking cams 30A–30D (see particularly FIG. 2) which are mounted on actuator shafts 32A–32D extending through overheight attachment legs 22A–22D and having twistlock couplings 34A–34D at the top end thereof and overheight attachment twistlocks 36A–36D at the bottom thereof for engaging a flat rack, pallet or similar flat cargo-carrying support.

With particular reference now to FIGS. 1 and 2, it can be seen that storage frame 40 includes four upstanding arms or supports 42A–42D which are each located at a respective one of the four corners of storage frame 40. At the base of storage frame supports 42A–42D are corresponding twistlock receiving plates 44A–44D which are configured so as to receive overheight attachment twistlocks 36A–36D within apertures 44A'–44D' when overheight attachment 20 is located in the first storage position on support frame 40 wherein upstanding supports 42A–42D are positioned immediately adjacent and behind each of overheight attachment legs 22A–22D. In this first location of overheight attachment 20 upon support frame 40, spring loaded plungers 46A–46D located at the top of corresponding supports 42A–42D serve to contact and bias latch arms 24A–24D outwardly into an open and inoperative latching position (see FIGS. 2 and 3). Plungers 46A–46D are biased upwardly by means of associated plunger springs 48A–48D.

Twistlock receiving plates 44A–44D of storage frame 40 also define second apertures 44A"–44D" therein for receiving overheight attachment twistlocks 36A–36D therein when overheight attachment 20 has been raised by spreader bar 10 and laterally shifted and lowered into the second storage position provided for by support frame 40. In the second storage position of overheight attachment 20 on support frame 40, upstanding supports 42A–42D and corresponding spring biased plungers 46A–46D are not located immediately behind overheight attachment legs 22A–22D and thus latch arms 24A–24D of overheight attachment 20 are not engaged and biased outwardly into an inoperative and unlatched position. Quite to the contrary, latch arms 24A–24D are biased inwardly towards an operative latched position by their respective latch arm springs 28A–28D unless retained in the unlocked position by the bottom legs thereof being retained above locking cams 30A–30D. When latch arms 24A–24D are being held in the open position by locking cams 30A–30D, they can be released (so as to allow them to move forwardly into an operative locked position with locking lugs 16A–16D of spreader bar 10) by rotating locking cams 30A–30D to allow the bottom legs of latch arms 24A–24D to slip through radial slots 30A'–30D' defined within the radial circumferences of locking cams 30A–30D. Once latch arms 24A-24D have been urged into an operative latched position by their respective latch arm springs 28A-28D they will be retained in this position (see FIGS. 5-8) since the bottom legs thereof will be locked beneath locking cams 30A-30D. This serves to assure a locking engagement between spreader bar 10 and overheight attachment 20 despite any lateral forces being applied to spreader bar 10 and overheight attachment 20 during cargo loading use thereof.

In order to unlock latch arms 24A-24D from their engagement with corresponding locking lugs 16A-16D of spreader bar 10, it is necessary to rotate locking cams 30A-30D so as to allow the bottom arms of latch arms 24A-24D to move upwardly through slots 30A'-30D' of locking cams 30A-30D. Thus it can be appreciated that locking cams 30A-30D associated with each corner locking mechanism of overheight attachment 20 (as shown in FIG. 2) serve as a mechanical interlock to lock latch arms 24A-24D into either an open or a closed position until the cams are selectively rotated so as to allow the bottom legs of latch arms 24A-24D to move either downwardly or upwardly, respectively, through slots 30A'-30D' construction of applicants' novel automated mechanism for locking spreader bar 10 to overheight attachment 20 so as to eliminate the necessity for manual attachment by mounting pins, applicants will now describe in specific detail below the intended method for use of the novel mechanism.

In operation, applicants' automated latching mechanism for securing an overheight attachment 20 to spreader bar 10 allows a crane operator to quickly and safely attach and detach overheight attachment 20 from spreader bar 10 during cargo handling operations. In the past, this has been a manual operation accomplished with mounting pins and typically requiring about 15 minutes to accomplish. It also subjected dock-side personnel to a considerable risk of injury due to the nature of the activity. With applicants' invention the attachment and detachment of overheight attachment 20 to spreader bar 10 can be accomplished in about 15 seconds by the crane operator without the necessity for assistance by dockside personnel. Thus, the automatic latching mechanism of the invention is quicker and eliminates the need for dock-side personnel as well as the attendant risk of injury to these personnel.

In operation and with particular reference to FIGS. 3-9 of the drawings, it should be appreciated that overheight attachment 20 is initially stored in the first position on storage frame 40 with spring biased plungers 46A-46D holding latch arms 24A-24D in the open and unlatched position and overheight attachment twistlocks 36A-36D positioned in apertures 44A'-44D' of twistlock receiving plates 44A-44D. Next, spreader bar 10 is positioned over overheight attachment 20 and lowered into engagement therewith by the crane operator who then locks spreader bar twistlocks 14A-14D (in a conventional manner well known to those skilled in the art) which have been received within respective twistlock couplings 34A-34D (see FIG. 3).

The crane operator now hoists spreader bar 10 and attached overheight attachment 20 about 12-18 inches and laterally shifts/lowers attached spreader bar 10 and overheight attachment 20 onto their second position on storage frame 40. In the second position, overheight attachment twistlocks 36A-36D are received within apertures 44A''-44D'' of twistlock receiving plates 44A-44D and latch arms 24A-24D are not engaged by corresponding plungers 46A-46D of storage frame support 40. In the second position, latch arm springs 28A-28D urge latch arms 24A-24D to move towards locking lugs 16A-16D of spreader bar 10 and into engagement therewith, but mechanical interlock locking cams 30A-30D act to stop movement of latch arms 24A-24D since the lower portion or bottom legs thereof rest upon the top surface of corresponding locking cams 30A-30D to prevent them from lockingly engaging spreader bar 10 (see FIG. 4).

The crane operator next rotates spreader bar twistlocks 14A-14D to the unlocked position so that latch arms 24A-24D complete their forward movement to their respective operative spreader bar engagement positions. As twistlocks 14A-14D are rotated to the unlocked position they serve to correspondingly rotate coupled actuator shafts 32A-32D and locking cams 30A-30D so that at an intermediate position between the locked and unlocked positions slots 30A'-30D' of the locking cams pass beneath corresponding bottom legs of latch arms 24D-24D and permit the latching arms to pass therethrough (see FIG. 5).

Overheight attachment 20 is now releasably locked (or latched) to spreader bar 10 and both are hoisted by the crane operator from the second position upon storage frame 40 and are in an operative mode to engage a cargo container. Should latching arms 24A-24D be bumped during cargo transfer operations, mechanical interlock locking cams 30A-30D will prevent latching arms 24A-24D from disengaging spreader bar locking lugs 16A-16D by trapping the lower portion or bottom legs of the latching arms thereunder (see FIG. 6).

Overheight attachment 20 is essentially a slave unit vis-a-vis spreader bar 10 and obtains its twistlock actuation from spreader bar 10. Once positioned on a flat rack, pallet or other similar flat cargo support, spreader bar twistlocks 14A-14D are locked which serves to rotate corresponding twistlock couplings 34A-34D and actuator shafts 32A-32D in order to rotate overheight attachment twistlocks 36A-36D to their locked position (see FIG. 7). Once overheight attachment twistlocks 36A-36D are locked onto a cargo container, the container C is lifted at its respective corner castings by overheight attachment twistlocks 36A-36D and the load is transferred to spreader bar 10.

When the cargo load transfer operation is completed by the crane operator, the operator positions spreader bar 10 and attached overheight attachment 20 over storage frame 40 and lowers overheight attachment 20 onto the first storage position thereon wherein overheight attachment twistlocks 36A-36D are received within apertures 44A'-44D' of twistlock receiving plates 44A-44D. In this position, plungers 46A-46D are urged against the bottom of latch arms 24A-24D which are prevented from unlatching due to the bottom legs thereof being trapped beneath mechanical interlock locking cams 30A-30D (see FIG. 8).

Finally, to complete the operation cycle, the crane operator locks spreader bar twistlocks 14A-14D so as to rotate mechanical interlock locking cams 30A-30D and to bring slots 30A'-30D' into position above the trapped bottom legs of latch arms 24A-24D so as to allow them to be urged upwardly therethrough. In this fashion, plungers 46A-46D serve to force the bottom portion or legs of latch arms 24A-24D through the slots of locking cams 30A-30D and thereby into the unlatched position. This is accomplished since the upward spring bias of plungers 46A-46D is greater than the downward bias of latch arm springs 28A-28D upon latch arms 24A–24D. The crane operator then unlocks spreader bar twistlocks 14A–14D and disengages spreader bar 10 from overheight attachment 20 so as to leave overheight attachment 20 in its first storage position upon storage frame 40 (see FIG. 9). When the operator desires to again utilize overheight attachment 20, the method of operation best shown in FIGS. 3–9 of the drawings is again practiced in utilizing the automatic latching mechanism of the present invention. It will be understood that various details of the invention may be changed without departing from the scope of the invention. Furthermore, the foregoing description is for the purpose of illustration only, and not for the purpose of limitation—the invention being defined by the claims.

What is claimed is:

1. A cargo loading system comprising:

a spreader bar assembly comprising a rectangular frame with a downwardly depending first twistlock at each corner thereof;

a detachably engageable overheight attachment comprising a frame having a leg depending downwardly from each corner thereof with a second twistlock at the bottom of said leg and the top of said leg adapted for engagement by said spreader bar assembly, said downwardly extending legs each including twistlock actuation means therein whereby each of said second twistlocks can be actuated by a corresponding one of said first twistlocks;

latching means operatively connected to said legs of said overheight attachment and adapted to be actuated by said first twistlocks of said spreader bar assembly for coupling of said spreader bar assembly and said overheight attachment; and an overheight attachment storage frame comprising a rectangular base defining first and second storage positions and having an arm extending upwardly from each corner thereof, said arms each having biasing means provided adjacent the upper end thereof for maintaining said latching means in an inoperative position when said overheight attachment is stored in said first storage position and in an operative position when said overheight attachment is stored in said second storage position

2. A cargo loading system according to claim 1 wherein said twistlock actuation means within each overheight attachment leg comprises a rotatably mounted shaft extending therethrough with the upper end thereof adapted to be releasably engaged by a respective one of said first twistlocks and the lower end connected to a corresponding one of said second twistlocks.

3. A cargo loading system according to claim 1 wherein said biasing means of said storage frame comprises a spring biased plunger element adapted to urge said latching means towards said inoperative position when said overheight attachment is stored in said first storage position.

4. A cargo loading system comprising:

a spreader bar assembly comprising a rectangular frame with a downwardly depending first twistlock at each corner thereof;

a detachably engageable overheight attachment comprising a frame having a leg depending downwardly from each corner thereof with a second twistlock at the bottom of said leg and the top of said leg adapted for engagement by said spreader bar assembly, said downwardly extending legs each including twistlock actuation means therein whereby each of said second twistlocks can be actuated by a corresponding one of said first twistlocks;

latching means operatively connected to said legs of said overheight attachment and adapted to be actuated by said first twistlocks of said spreader bar assembly for coupling of said spreader bar assembly and said overheight attachment, said latching means comprising:

a latch member pivotably mounted adjacent the top end of each of said legs of said overheight attachment and adapted to engage said spreader bar assembly when pivotably urged to an operative position;

biasing means operatively connected to said latch member for urging said latch member towards said operative position; and latch member locking means operatively connected to each of said twistlock actuation means for locking a corresponding latch member in the inoperative and operative positions; and an overheight attachment storage frame comprising a rectangular base defining first and second storage positions and having an arm extending upwardly from each corner thereof, said arms each having biasing means provided adjacent the upper end thereof for maintaining said latching means in an inoperative position when said overheight attachment is stored in said first storage position and in an operative position when said overheight attachment is stored in said second storage position.

5. A cargo loading system according to claim 4 wherein said latch member comprises an L-shaped latch arm and said latch member locking means comprises an annular cam defining a slot in the circumference thereof wherein the top end of said latch member is adapted to engage said spreader bar assembly and the bottom end thereof is adapted to pivot through the slot in said cam when said cam is caused to rotate by said twistlock actuation means.

6. A cargo loading system according to claim 4 wherein said twistlock actuation means within each overheight attachment leg comprises a rotatably mounted shaft extending therethrough with the upper end thereof adapted to be releasably engaged by a respective one of said first twistlocks and the lower end connected to a corresponding one of said second twistlocks.

7. A cargo loading system according to claim 4 wherein said biasing means of said storage frame comprises a spring biased plunger element adapted to urge said latching means towards said inoperative position when said overheight attachment is stored in said first storage position.

8. A cargo loading system according to claim 4 wherein said first and second storage positions defined by said base of said overheight attachment storage frame comprise first and second apertures adjacent each corner thereof for receiving said second twistlocks of said overheight attachment therein when said overheight attachment is stored in said first and second storage positions, respectively.

9. A cargo loading system for use with a spreader bar assembly of the type comprising a rectangular frame with a downwardly depending first twistlock at each corner thereof, said cargo loading system comprising:

a detachably engageable overheight attachment comprising a frame having a leg depending downwardly from each corner thereof with a second twistlock at the bottom of said leg and the top of said leg adapted for engagement by said spreader bar assembly, said downwardly extending legs each including twistlock actuation means therein whereby each of said second twistlocks can be actuated by a corresponding one of said first twistlocks;

latching means operatively connected to said legs of said overheight attachment and adapted to be actuated by said first twistlocks of said spreader bar assembly for coupling of said spreader bar assembly and said overheight attachment; and an overheight attachment storage frame comprising a rectangular base defining first and second storage positions and having an arm extending upwardly from each corner thereof, said arms each having biasing means provided adjacent the upper end thereof maintaining said latching means in an inoperative position when said overheight attachment is stored in said first storage position and in an operative position when said overheight attachment is stored in said second storage position.

10. A cargo loading system according to claim 9 wherein said twistlock actuation means within each overheight attachment leg comprises a rotatably mounted shaft extending therethrough with the upper end thereof adapted to be releasably engaged by a respective one of said first twistlocks and the lower end connected to a corresponding one of said second twistlocks.

11. A cargo loading system according to claim 9 wherein said biasing means of said storage frame comprises a spring biased plunger element adapted to urge said latching means towards said inoperative position when said overheight attachment is stored in said first storage position.

12. A cargo loading system for use with a spreader bar assembly of the type comprising a rectangular frame with a downwardly depending first twistlock at each corner thereof, said cargo loading system comprising:

a detachably engageable overheight attachment comprising a frame having a leg depending downwardly from each corner thereof with a second twistlock at the bottom of said leg and the top of said leg adapted for engagement by said spreader bar assembly, said downwardly extending legs each including twistlock actuation means therein whereby each of said second twistlocks can be actuated by a corresponding one of said first twistlocks;

latching means operatively connected to said legs of said overheight attachment and adapted to be actuated by said first twistlocks of said spreader bar assembly for coupling of said spreader bar assembly and said overheight attachment, said latching means comprising:

a latch member pivotably mounted adjacent the top end of each of said legs of said overheight attachment and adapted to engage said spreader bar assembly when pivotably urged to an operative position;

biasing means operatively connected to said latch member for urging said latch member towards said operative position; and latch member locking means operatively connected to each of said twistlock actuation means for locking a corresponding latch member in the inoperative and operative positions; and an overheight attachment storage frame comprising a rectangular base defining first and second storage positions and having an arm extending upwardly from each corner thereof, said arms each having biasing means provided adjacent the upper end thereof for maintaining said latching means in an inoperative position when said overheight attachment is stored in said first storage position and in an operative position when said overheight attachment is stored in said second storage position.

13. A cargo loading system according to claim 12 wherein said latch member comprises an L-shaped latch arm and said latch member locking means comprises an annular cam defining a slot in the circumference thereof wherein the top end of said latch member is adapted to engage said spreader bar assembly and the bottom end thereof is adapted to pivot through the slot in said cam when said cam is caused to rotate by said twistlock actuation means.

14. A cargo loading system according to claim 12 wherein said twistlock actuation means within each overheight attachment leg comprises a rotatably mounted shaft extending therethrough with the upper end thereof adapted to be releasably engaged by a respective one of said first twistlocks and the lower end connected to a corresponding one of said second twistlocks.

15. A cargo loading system according to claim 12 wherein said biasing means of said storage frame comprises a spring biased plunger element adapted to urge said latching means towards said inoperative position when said overheight attachment is stored in said first storage position.

16. A cargo loading system according to claim 12 wherein said first and second storage positions defined by said base of said overheight attachment storage frame comprise first and second apertures adjacent each corner thereof for receiving said second twistlocks of said overheight attachment therein when said overheight attachment is stored in said first and second storage positions, respectively.

* * * * *